United States Patent [19]

Burdette

[11] Patent Number: 4,596,713

[45] Date of Patent: Jun. 24, 1986

[54] MICROWAVE FOOD PACKETS CAPABLE OF DISPERSING A FOOD ADDITIVE DURING HEATING

[76] Inventor: Darrell C. Burdette, 90 Allison Dr., Florence, Ky. 41042-0191

[21] Appl. No.: 608,920

[22] Filed: May 10, 1984

Related U.S. Application Data

[63] Continuation-in-part of Ser. No. 484,867, Apr. 14, 1983, abandoned.

[51] Int. Cl.[4] ..... B65D 81/34; B65D 27/08

[52] U.S. Cl. ..... 426/107; 426/113; 426/120; 426/124; 206/219

[58] Field of Search ..... 426/113, 107, 120, 115, 426/112, 114, 124, 234, 243, 118; 206/219

[56] References Cited

U.S. PATENT DOCUMENTS

| | | | |
|---|---|---|---|
| 1,570,346 | 1/1926 | Hahn | 206/219 |
| 1,572,323 | 2/1926 | Smith | 206/219 |
| 2,606,121 | 8/1952 | Peters | 426/120 |
| 2,633,284 | 3/1953 | Moffett et al. | 426/113 |
| 2,741,559 | 4/1956 | Banowitz | 426/120 |
| 2,899,318 | 8/1959 | Long | 426/112 |
| 2,980,540 | 4/1961 | Turpin | 426/112 |
| 3,293,048 | 12/1966 | Kitterman | 426/113 |
| 3,360,440 | 12/1967 | Haab et al. | 426/120 |
| 3,386,837 | 6/1968 | Arnot | 426/112 |
| 3,398,041 | 8/1968 | Ferree | 426/414 |
| 3,410,697 | 11/1968 | Stephenson | 426/114 |
| 3,465,873 | 9/1969 | Munz | 426/114 |
| 3,573,069 | 3/1971 | Keller et al. | 426/120 |
| 3,672,916 | 6/1972 | Virnig | 426/113 |
| 3,743,520 | 7/1973 | Croner | 426/112 |
| 3,796,813 | 3/1974 | Kurland | 426/132 |
| 3,851,571 | 12/1974 | Nichols | 426/113 |
| 3,851,574 | 12/1974 | Katz et al. | 426/107 |
| 3,873,735 | 3/1975 | Chalin | 426/113 |
| 4,133,896 | 1/1979 | Standing et al. | 426/113 |
| 4,137,333 | 1/1979 | Daswick | 426/113 |
| 4,166,208 | 8/1979 | Martel et al. | 426/243 |
| 4,210,674 | 7/1980 | Mitchell | 426/113 |
| 4,233,325 | 11/1980 | Slangan et al. | 426/113 |
| 4,292,332 | 9/1981 | Meham | 426/113 |
| 4,299,851 | 11/1981 | Lowe | 426/113 |
| 4,390,554 | 6/1983 | Levinson | 426/113 |
| 4,399,158 | 8/1983 | Bardsley et al. | 426/112 |
| 4,404,241 | 9/1983 | Mueller et al. | 426/113 |
| 4,450,180 | 5/1984 | Watkins | 426/107 |

FOREIGN PATENT DOCUMENTS

| | | | |
|---|---|---|---|
| 23799 | 2/1981 | European Pat. Off. | 426/447 |
| 650961 | 3/1951 | United Kingdom | 426/113 |

*Primary Examiner*—Steven Weinstein
*Attorney, Agent, or Firm*—Frost & Jacobs

[57] ABSTRACT

A microwave food package for preparing foods such as shelf-stable popcorn containing a packet of food additive or flavoring which is automatically dispersed over the food product when the package is heated by microwave radiation within the microwave oven during the cooking cycle. The package is constructed from a paper/polyester laminate and includes vent holes covered with a heat softenable polypropylene film for regulating the pressure and temperature within the package. The packet containing the additive or flavoring is also constructed from a polypropylene film which softens and eventually tears under heat and pressure within the package to disperse its contents over the product.

28 Claims, 6 Drawing Figures

MICROWAVE FOOD PACKETS CAPABLE OF DISPERSING A FOOD ADDITIVE DURING HEATING

This application is a continuation in part of Ser. No. 484,867, filed Apr. 14, 1983, now abandoned.

The present invention relates generally to microwave food packages for preparing foods and snacks, and more particularly to such a package containing a self-contained packet of a food additive or flavoring such as syrups, gravies, oil, butter and the like, which is positioned within the package and designed to automatically disperse the additive or flavoring over the food while the package is being heated in a microwave oven. The present invention finds particular application to a microwave food package containing popcorn wherein the packet contains an appropirate popcorn additive or flavoring such as oil or butter.

The recent popularity and widespread use of microwave ovens has created a need for food packages which are usable within the microwave without the necessity of additional utensils or containers for holding the food while it is being heated or cooked. As opposed to conventional radiant heat cooking techniques which use cooking oils, water or other fluids to cook the food, cooking within a microwave oven is a relatively dry and fluid-free cooking process. Nonetheless, in many cases it is desirable to add an additive or flavoring such as gravy, butter, oil, cheese, or the like to the food. For example, popcorn is conventionally prepared by popping it in a corn popper, pan or other similar type of utensil with oil or butter which not only prevents it from burning or charring, but also provides it with a certain amount of flavoring. Recently it has become popular and convenient to package the popcorn kernals in a specially designed expandable paper package which can be heated in a microwave oven, thereby popping the corn. This completely eliminates the need for a separate container or utensil.

In many cases, however, it is still desirable to have the popcorn prepared in such a microwave oven package and the oil and butter flavoring normally present when the popcorn is prepared by more traditional techniques. Usually, this need is met by adding the additive or flavoring to the popcorn after popping is completed and the package is opened, just prior to eating. This, of course, requires an extra step in the preparation process, as well as a separate container for the additive or flavoring. In one method of microwave popcorn popping, the popcorn kernals, oil and flavorings are mixed together in a flexible package. Generally, with methods of this kind, freezing is required to preserve the coconut oil. In some methods, however, freezing of the oil is not required. However, it has been found that using such methods, the oil may leave an oily flavor on the popcorn.

The present invention is directed to a microwave food package construction which includes a self-contained internal packet containing an additive or flavoring which is automatically added to the popcorn or other food during the cooking or warming cycle, thus simplifying preparation of the food. In addition to the automatic dispersal of the flavoring or additive onto the food during the cooking cycle within the microwave oven, the present invention also incorporates several other important features which make it useful as a microwave cooking package. For example, the package containing the food and additive or flavoring is stable so that it can be stored on a shelf of a grocery store without requiring refrigeration, freezing or other special preservative precautions prior to use. This long shelf life enhances the marketability of the package while lowering the handling and storage costs, without requiring freezing or refrigeration. Consequently, less energy is required to bring the internal popcorn kernal temperature up to popping temperature which results in a higher percentage of the kernals being popped. Similarly, the package reduces the effort required on the part of the user in preparing the food, and also eliminates the chance for error, such as in measuring the proper amount of flavoring or additive, or adding it to the food at just the right point in the cooking or warming cycle. Likewise, the entire package is self-contained within the closed chamber of the microwave oven so that the user does not become splattered with hot oil or flavorings during heating of the food product. Finally, the self-contained packet is designed to effectively and automatically disperse the flavoring or additive over the entire food charge within the package without intervention by the user, and while the package is still in a closed condition.

In a preferred embodiment of the present invention, the food package contains means in the form of a pouch-like internal packet which is designed to automatically disperse a predetermined quantity of additive or flavoring over the food contained within the package while the package is being heated within a microwave oven. As used herein, the term "package" will be understood to have reference to the outermost bag-like container or sometimes to the entire structure, while the term "packet" will be understood to be referring to the internal pouch-like container holding the additive or flavoring. In addition, the term "additive" includes additives, flavorings, sauces, seasonings or any other substance which can be added to food.

In general, the package comprises a flexible expandable closed bag-like container which may be fabricated from a multi-ply laminate of kraft paper and polyester film. The package contains a measured charge of food, such as popcorn kernals. The construction of the package itself is similar to conventional microwave food packages, particularly those used for popping popcorn, and is so designed as to expand as the popped corn fills the interior of the package. In addition, vent holes may be provided in the package to control the heat and pressure therewithin. Furthermore, the cavity formed within the package provides storage space for the food additive or flavoring package to be described hereinafter. In any event, the materials utilized for the construction of the package are substantially transparent to microwave energy, and provide an effective air, moisture and grease barrier to enhance the shelf storage of the food and prevent leakage of fluids from within the package.

A pouch-like packet is contained within the package, and is formed as either a separate bag-like receptacle or as part of the inner wall of the package. A food additive or flavoring such as butter, oil or the like is sealed within the packet in a liquid, hardened, semi-hardened or gelatinous state. The packet is made of a material such as a thermoplastic film which softens sufficiently during the heating process within the microwave oven that internal pressure and heat causes the film to soften, stretch and finally tear, thus dispersing the food additive onto the food heating within the food package. As will be described in more detail hereinafter, it is believed that several factors contribute in the operation of the present invention to the automatic opening of the packet at a particular point in the heating or warming cycle. For example, since the amount of moisture released from the food effects the vapor pressure and temperature within the packet, it may have an effect on the temperature of the film, and thus the point at which the packet material softens sufficiently to tear. This can be regulated by not only the selection and quantity of food within the package, but also by providing vents in the package for releasing moisture, heat and pressure. The volume of the package cavity also operates to control the temperature and pressure conditions within the package, and thus the packet environment. The fact that the package is sealed also contributes to the pressure/-temperature characteristics within the package, and can be controlled by the specific construction of the package as well as the provision of heat and/or temperature release vents in the package wall as noted. The heating capability of the microwave oven is another factor which contributes to the overall heating rate of the package, contents and packet. It has also been found that the amount of food material within the package and the amount of additive or flavoring within the packet also effects the softening characteristics of the packet material. In the preferred embodiment, the packet is attached or formed as part of the upper center wall of the package which not only effects the softening characteristics of the packet film material, but also serves to evenly disperse the additive or flavoring over the food when the packet opens. In addition, locating the packet in the central portion of the package overlying the food eliminates burning and charring of the packet film as well as the food within the package cavity. This is due in part to the fact that the package cavity, at least in the case of a popcorn package, heats up faster than the packet cavity containing the oil. This is because the microwave energy reacts faster to water contained in the popcorn kernals than to water contained in the packet. Thus, the internal pressure of vapor expanding within the package cavity accelerates the cavity temperature which better conducts heat to aid the accelerated temperature of the packet. In the case of a popcorn package, the temperature and pressure within the package cavity, coupled with the internal temperature and pressure within the packet aids the softening of the packet film. Finally, the thickness and tensile strength of the packet material also effects the softening and tearing characteristics.

In use, the food package is placed in a microwave oven and heated to a desired temperature. At a particular point in the heating cycle, the walls of the packet soften sufficiently that internal pressure as well as the weight of the flavoring or additive contained within the packet causes the heat softened packet walls to stretch and finally to tear. This permits the additive or flavoring to be dispersed substantially evenly over the food contained within the flexible package container.

In another embodiment of the present invention, a heat releasable adhesive is used to seal the additive or flavoring within the packet along a central seam in the packet wall. As the temperature within the package cavity reaches a preselected temperature, the adhesive seal in the central seam releases to disperse the food additive or flavoring onto the food contained within the package.

The package may further include a pressure-temperature control feature to regulate the temperature and pressure within the flexible closed package container within a preselected temperature range. In a preferred embodiment, the pressure and temperature control means comprises a plurality of holes in the package wall. The holes are covered over with a thermoplastic film (for example, the same type of film material used to construct the packet). As the temperature within the package reaches the temperature at which the thermoplastic material begins to soften, the internal pressure within the package causes the softened thermoplastic material to stretch and finally tear open in order to create air holes which vent the excess pressure from within the package and thereby regulate the temperature there within.

As will be described in more detail hereinafter, the packet may be constructed as a separate bag-like pouch attached to the upper interior wall of the package, or may be formed from the thermoplastic material as an integral part of the interior wall of the package. Alternately, the packet may be formed as a pocket-like cavity inserted through an opening in the upper outer wall of the package, the opening being thereafter closed after the pocket-like cavity has been filled with the appropriate flavoring or additive.

Further features of the invention will become apparent from the detailed description which follows.

DETAILED DESCRIPTION OF THE INVENTION

Figure 2:
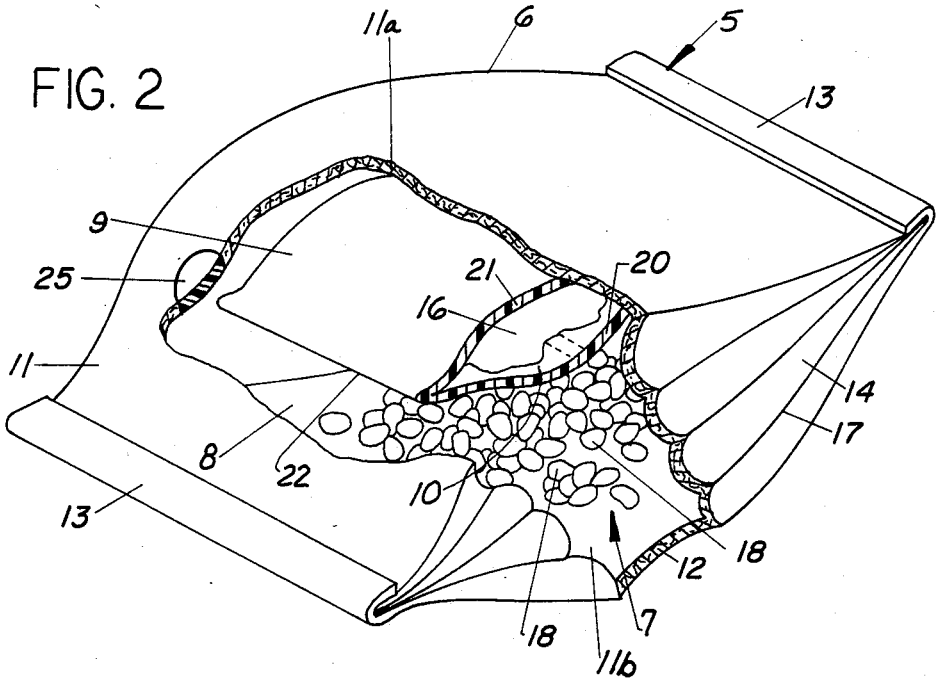
FIG. 2 is a front prospective view of one embodiment of the package of the present invention.
Figure 4:
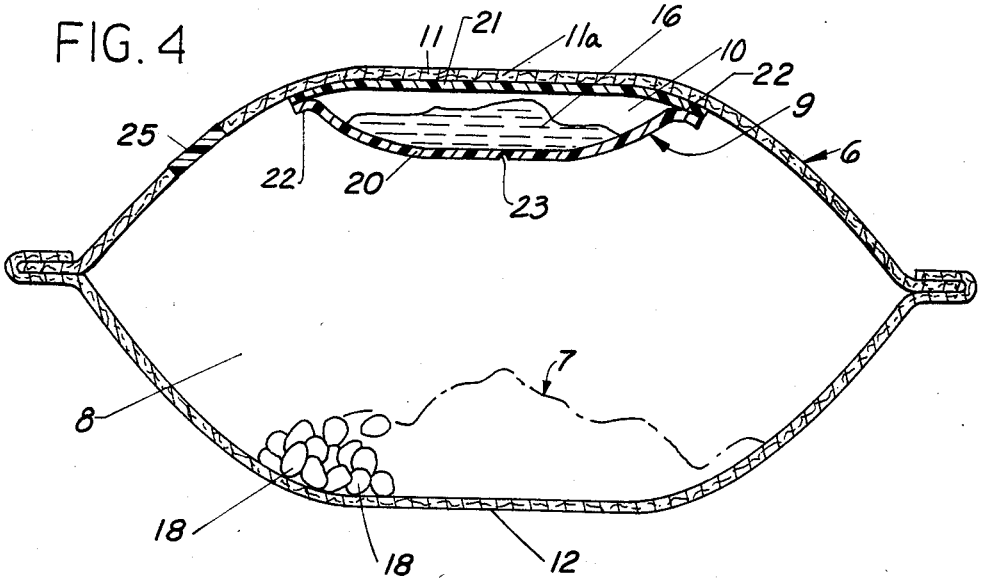
FIG. 4 is a side elevational cross-sectional view of the package of FIG. 1.

A first embodiment of the microwave oven food package of the present invention is illustrated generally at 5 in FIG. 2 and FIG. 4. In general, food package 5 comprises a flexible expandable closed bag-like container or package 6 containing a charge of food, shown generally at 7, held within the interior cavity 8 of package 6. Package 6 also includes a pouch-like closed packet 9, which is disposed within cavity 8 of package 6. Packet 9 includes an interior cavity 10 enclosing a predetermined quantity of additive, flavoring or the like 16 as will be described in more detail hereinafter. In the embodiment illustrated, packet 9 is attached to the central portion of the upper interior wall of package 6.

Figure 1:
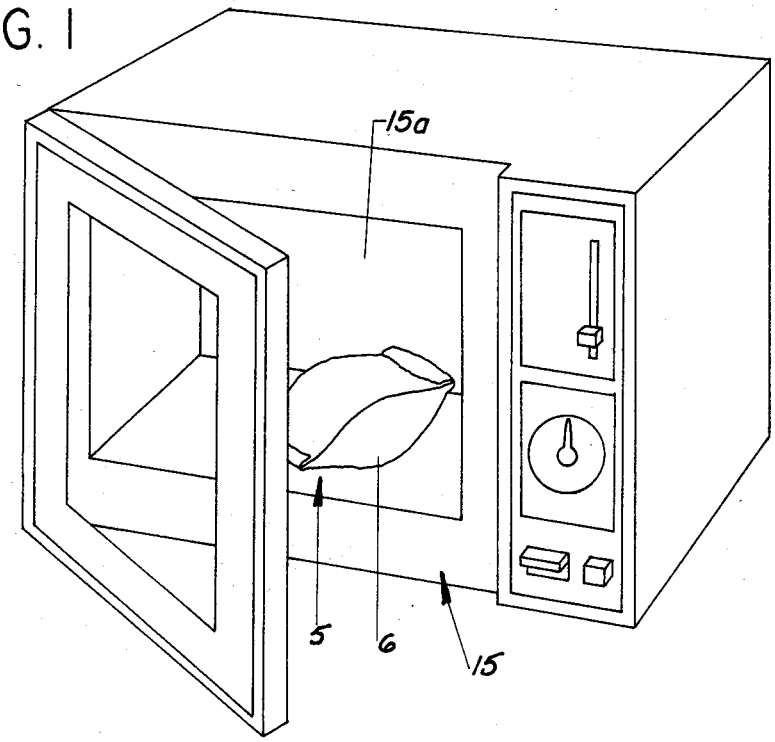
FIG. 1 is a front prospective view of the package of the present invention in place within the heating cavity of a conventional microwave oven.

As illustrated in FIG. 1, and as will be described in more detail hereinafter, the package 5 is placed within the internal cavity 15(*a*) of a conventional microwave oven 15 which heats package cavity 8, packet cavity 10, and the food charge 7 and additive or flavoring 16 contained therein, respectively. In general, as the temperature and pressure within the interior package 6 increases due to the heating effects of the microwave energy produced by microwave oven 15, the film material forming the walls of packet 9 softens sufficiently to stretch and finally to tear open, thereby dispersing additive or flavoring 16 over the food charge 7.

Package 6 is essentially bag-like in construction, and includes an upper wall 11, and a spaced lower wall 12. The ends of walls 11 and 12 are secured together by means of overlapping folded portions 13.

The longitudinal marginal edges of upper and lower walls 11 and 12 are joined together by means of a gusset portion 14. Gusset portion includes a number of longitudinally extending folded pleats, one of which is shown at 17, which permits package 6 to normally lie flat, but to expand to increase the volume of interior cavity 8 upon heating in a microwave oven. For example, in the embodiment where food charge 7 comprises a plurality of popcorn kernals, one of which is shown at 18, package 6 will normally assume a partly flattened condition (with pleats 17 partially expanded) to accommodate the volume of the popcorn kernals 18 and packet 9 within cavity 8 of the package. However, upon heating within a microwave oven, the increased vapor pressure within the package cavity caused by the popping corn causes the package to expand so as to provide room for the popped kernals. When this occurs, pleats 17 permit the pouch-like package 6 to expand to accommodate the increased volume. In any event, the gussets must expand freely to accommodate moisture expanding to vapor within the flexible package 6. In the case of a popcorn package, the expanded cavity 8 within the package provides the space requirements for vaporized moisture from the popped kernals.

Package 6 may be constructed from any flexible material which is generally transparent to microwave energy and nonflammable within the temperature range encountered within the microwave oven. One suitable choice of material is single ply kraft paper. This material not only provides adequate protection for the food charge, but also provides an outer surface which can easily accept printing, i.e. advertising or instructions. In order not to attenuate the microwave energy, the ink utilized for printing on the package surface should contain less than about 5% pigment.

Alternately, a multiple layer laminated construction may be used for the package walls, such as alternate layers of kraft paper and a heat resistant microwave energy transparent plastic film such as polyester or a glassine lamination. The paper outer layer provides a good surface for printing as noted above, and also wear and abrasion resistance. The film interlayer provides a barrier to air, moisture and grease to maintain the freshness of the food charge 7, as well as prevent any fluids associated with the food product from leaking from package 6. It will be observed that the kraft paper and glassine lamination construction may be used for shorter time and temperature requirements, or where storage and air, oil and moisture resistance are less important. In any event, the material from which the package walls are formed should have the ability to accommodate a temperature range commensurate with the food to be cooked inside. For example, in the case of popcorn, a preferred construction comprises a 35 pound bag weight kraft paper outer layer laminated to a 45 gauge polyester interior layer. It will also be understood that a single layer construction may be used with an appropriate impervious coating applied thereto.

Packet 9 is manufactured from a film material which will soften sufficiently when heated so that internal pressure will cause the film to soften, stretch and finally tear in order to disperse the food additive or flavoring 16 over the surface of the food charge 16. For example, packet 9 may be fabricated from a thin film 19 of thermoplastic material which is substantially transparent to microwave energy. The particular type of material chosen, its thickness, tensile strength and other characteristics, will depend upon the construction and dimensions of package 6 and packet 9, the type of food charge 7 and additive or flavoring 16 used, and the temperature and pressure conditions within the package during the heating cycle. These factors include the amount of moisture released from the food during heating which can be regulated by the selection and quantity of food, as well as its moisture content and the volume of the sealed package cavity. The temperature-pressure properties of the food additive or flavoring 16 are also important in considering the internal pressure formed within cavity 10 of packet 9 as the additive or flavoring is heated. In other words, the point at which the film walls 19 of packet 9 are sufficiently softened so as to tear will be influenced not only by the temperature of the walls but also by internal pressure within cavity 10 created by the expansion of or vapor releases from the additive or flavoring. Another important characteristic is that the type of film 19 chosen for packet 9 adhere to the package wall after its contents are dispensed so that no part of the film shred or become mingled with the food product or flavoring or additive. Of course, the film must not affect the food or flavoring or additive particularly when heated.

The internal temperatures of package 6 and packet 9 are also important and may be regulated by the size and construction of the package and packet, the energy output of the microwave oven, venting of the package through appropriate vent openings as will be described hereinafter, the relative transparency of the various materials forming package 6 and packet 9 to microwave radiation, the degree to which the food charge and food additive or flavoring fill their respective cavities, the moisture content and quantity of food charge, the degree that the food additive or flavoring fills the cavity within the packet, the amount of surface film forming the packet that is actually attached to the inside wall surface of the package, etc. Furthermore, the location of packet 9 within the package cavity 8 is also an important factor. For example, in the embodiment illustrated, packet 9 depends from the central portion of the upper interior wall 11 of package 6. Consequently, the weight of the additive or flavoring 16 within the packet cavity 8 will also contribute to the point at which the film 19 tears during the heating cycle. As noted hereinafter in the embodiment where the packet 9 is formed from adhesively joined walls, the tear point will be influenced by the release temperature of the adhesive.

In any event, packet 9 will be so constructed so as to release its contents at a particular point during the heating cycle of package 6.

For example, in the case of a microwave popcorn package, it has been found that a film 19 fabricated from 45 gauge polypropylene will release its contents within the temperature range at which popcorn kernals pop, i.e. about 160° C.–180° C., and preferably about 165° C.–170° C., since, in general, such a polypropylene film having a thickness of about 0.6–0.8 mil will soften at a temperature of about 160° C. and lose its tensile strength within the range of about 168° C.–171° C. On the other hand, if the food charge 7 is leftover meat, for example, which is only to be warmed, packet 9 may be made from a material which will open to dispense its contents at a much lower temperature range, e.g. 100° C.–150° C. It will be understood that a thinner film will generally soften and tear more easily than a thicker film, while a thermoplastic film which softens at a lower temperature will likewise tear at a lower temperature. Preferably, the additive or flavoring 16 within packet 9 will fill approximately 75–100% of cavity 10 so as to produce a sufficient build-up of pressure to cause the packet to tear as package 6 is heated. Furthermore, the interior pressure within cavity 10 may be enhanced, for example, by using a water-oil mixture wherein steam will be produced by the water at a temperature of about 100° C. to augment the internal pressure.

In any event, the food additive or flavoring 16 sealed within the interior cavity 10 or packet 9 may be selected from a wide range of food products either liquid, solid, semi-liquid, gelatineous or combinations thereof. A wide variety of oils, such as coconut oil, cooking oils, olive oil, soy bean oil, and the like, may be used as well as butter, margarine, syrups, cheeses etc. If the food charge 7 is a meat dish, various sauces, gravies or other meat flavorings may be utilized as the additive or flavoring. Again, the opening characteristics of packet 9 may be influenced by a certain extent to the heating and vaporization characteristics of the additive or flavoring 16.

As thus shown in FIG. 4, packet 9 is formed with a lower wall 20 and an upper wall 21 joined thereto so as to form a closed pouch-like receptacle having interior cavity 10. In a preferred embodiment, both walls 20 and 21 may be formed from films 19 of thermoplastic material. In an alternate embodiment, lower wall 20 may be fabricated from the thermoplastic film 19, while upper wall 21 may be fabricated from the same material as upper wall 11 of package 6. As a further example, in the case where wall 11 is constructed from a multiple-ply paper and polyester film material, upper packet wall 21 may be constructed from a similar type of polyester film.

As can be seen, packet 9 is attached to the central portion of the interior surface of upper wall 11 of package 6, immediately above the food charge 7. This permits the additive or flavoring 16 contained within the packet to fall downwardly on food charge 7 when the packet softens and opens and serves to evenly disperse the additive or flavoring over the food charge 7.

In the embodiment illustrated, upper wall 21 is secured to the undersurface of upper wall 11 of package 6 by means of a suitable adhesive. For example, it has been found that surylan adhesive applied at a rate of 7–10 pounds per ream may be used to laminate the packet film to the inner wall of the package, and also acts as an effective grease barrier. Likewise, in the case where packet 9 is formed from separate upper and lower walls, the edges of the adjoining walls may be sealed by a similar type of adhesive as at 22 or by heat sealing or other means. In all events, it is preferred that packet 9 be attached to the central portion of upper wall 11 so as to be located directly above food charge 7. This permits the additive or flavoring 16 to be evenly dispersed over the food charge. Furthermore, the upper wall location of the packet is in many cases essential to eliminate charring and burning of the packet film as well as the food contents of the package cavity. In a situation where a thicker higher temperature film is used for the packet utilizing side seams joined by a heat releasable adhesive, and where the food within the package has a high resistance to charring and burning, the location of the packet within the package cavity may be less important.

It will be understood that packet 9 may be made from other types of thermoplastic films such as polyolefin, or polyethylene or a resin laminated film. In the embodiment in which the package is used to contain popcorn, packet 9 will be so constructed as to contain 1–4 ounces of food additive or flavoring 16, with a preference of 1–2 ounces. Furthermore, where packet 9 is fabricated from a film 19 of polypropylene having a thickness of about 0.6–0.8 mil, the film will soften and tear, thus releasing the packet contents within about 1½–4 minutes after being placed within a microwave oven. It will be observed that this timing usually coincides with the beginning of the popping of the popcorn kernals contained within package 6.

In general, it is preferred that the food additive or flavoring fill approximately 75–100% of the volume of the interior cavity 10 of packet 9 so as to create a sufficient build-up of pressure to cause it to tear as it is heated. Increased internal pressure of the packet can be achieved by introducing nitrogen with the food additive or flavoring within packet 9. When the nitrogen is heated, it will expand in volume thereby producing additional internal pressure to soften, stretch and finally tear film 19 to disperse a food additive or flavoring. This construction is especially useful when the food additive or flavoring is to be dispersed over the food in the package cavity early in the cooking cycle.

In an alternate embodiment, a lower wall 20 may be provided in two parts, joined together along a transversely extending central seam 23. This method of attaching the films may be in lieu of or in addition to the construction utilizing sealed edges 22 as previously described. The particular sealant chosen may be selected as described hereinabove to melt and open packet 9 as the temperature in package 6 reaches a desired temperature. Such a sealing technique is especially useful when the thermoplastic film 19 comprising packet 9 has properties which cause it to soften and tear at a temperature higher than that at which it is desired to disperse the food additive 16 onto the food 7. Consequently, the sealant may be selected so as to cause the packet to open at a lower, preselected temperature. In addition, opening of the packet along central seam 23 may also be used to provide a more uniform distribution of the food additive or flavoring 16 onto the food 7 than may be possible with a packet sealed along edges 22. In all cases, the sealant chosen, as well as the thermoplastic film used, should be relatively pigment free with a pigment content of less than about 5% so that the packet remains substantially transparent to microwave radiation in order to avoid interference with the heating operation of the microwave oven.

As noted herein above, packet 9 may be attached to the interior surface of upper wall 11 by a pigment-free adhesive such as surlyn. In all events, such adhesive should be selected so as not to become attached from the interior wall of package 6 at the highest maximum temperature to be expected within the package interior. For example, in the case of a popcorn package, the maximum temperature expected is about 260° C. It will be understood that various pressure seals can also be used to attach packet 9 to wall 11. It will be further understood that it is believed that the amount of surface area of packet 9 which is attached to the undersurface of upper wall 11 will effect the tightness and pressure within pocket cavity 10, thereby also effecting the point at which the packet walls soften and tear. Consequently, it is believed desirable in some cases to have at least some of the film 19 forming upper wall 21 of packet attached to the undersurface of upper wall 11 of package 6 so that at least part of the periphery of the film is attached to a fixed pointed.

Figure 5:
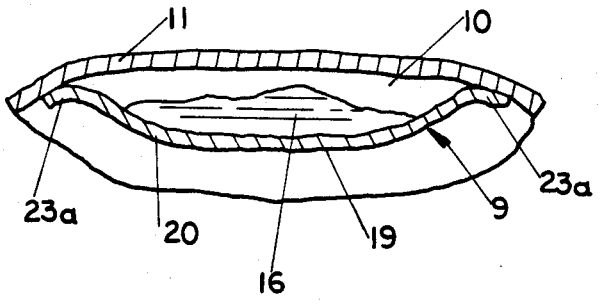
FIG. 5 is a fragmentary cross-sectional view illustrating an alternate way of forming the packet.

An alternate construction of attaching packet 9 to package 6 is illustrated in FIG. 5, where elements similar to those previous described have been similarly designated. In this arrangement, packet 9 is formed from a single film 19 of thermoplastic film or the like forming only lower wall 20. Wall 20 may be sealed to the undersurface of upper wall 11 of package 6 as at 23(*a*) by heat sealing, adhesive or the like. It will observed that this method of construction permits the thermoplastic film to be laminated directly to the undersurface of wall 11. In all other respects, the construction and operation of the packet is the same as previously described herein.

Figure 6:
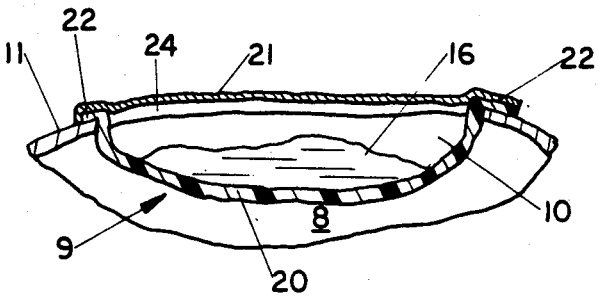
FIG. 6 is a fragmentary cross-sectional view illustrating another alternate way of forming the packet.

Another construction for attaching packet 9 to package 6 is illustrated in FIG. 6, where elements similar to those previously described have been similarly designated. In this arrangement, the construction of packet 9 is similar to that described in connection with the embodiment of FIG. 4 and includes a lower wall 20 constructed of a thermoplastic film and an upper wall 21 constructed from a heat resistant material, such as kraft paper or a paper and polyester laminate. The peripheral edges of walls 20 and 21 are joined by an adhesive, heat sealing or the like as at 22. The interior cavity 10 of packet 9 is filled with a suitable additive or flavoring material 16.

A circular, rectangular, square, or other shaped opening 24 is provided in the central portion of upper wall 11 of package 6 immediately overlying the food charge 7. Lower wall 20 and the portion of the packet containing the additive or flavoring 16 is inserted through the opening so that it depends from the central portion of upper wall 11 within cavity 8 of package 6. Upper wall 21 of packet 9 is dimensioned to be of the same shape and slightly larger than opening 24 so that the peripheral sealed edges 22 of the upper and lower walls extend beyond the peripheral edges of opening 24 so as to completely cover this opening. The sealed edges 22 may then be secured to the outer surface of upper wall 11 by glueing, heat sealing or the like to close the opening in the top of package 6. It will be observed that this construction permits the packet 9 to be formed and filled separately from package 6 and thereafter the packet and package secured together as described. In all other respects, the operation and construction of the packet and package is the same as previously described.

The food package of the present invention also includes means for automatically regulating the temperature and pressure within the closed package 6. In the preferred embodiment, package 6 is provided with a plurality of openings, one of which is shown at 25. Openings 25 serve as air vents which prevent the pressure from building up beyond a predetermined point within package cavity 8 to keep the package from bursting, as well as limiting the amount of heat build-up within the package. Opening 17 may be left open, or preferably plugged or covered with a thermoplastic film 19 similar to that described in connection with the wall material used for packet 9. Consequently, as the temperature within cavity 8 reaches the softening temperature of film 19, the film covering opening 17 will soften, stretch and finally tear, aided by the internal pressure within cavity 8, thereby opening the air vents and releasing pressure within package 6. Alternately, patches of paper or other material may be secured over opening 17 by means of a heat releasable adhesive which causes the plugs or covers to become detached from the outer surface of package 6 when a predetermined temperature (e.g. 160° C. is reached).

Figure 3:
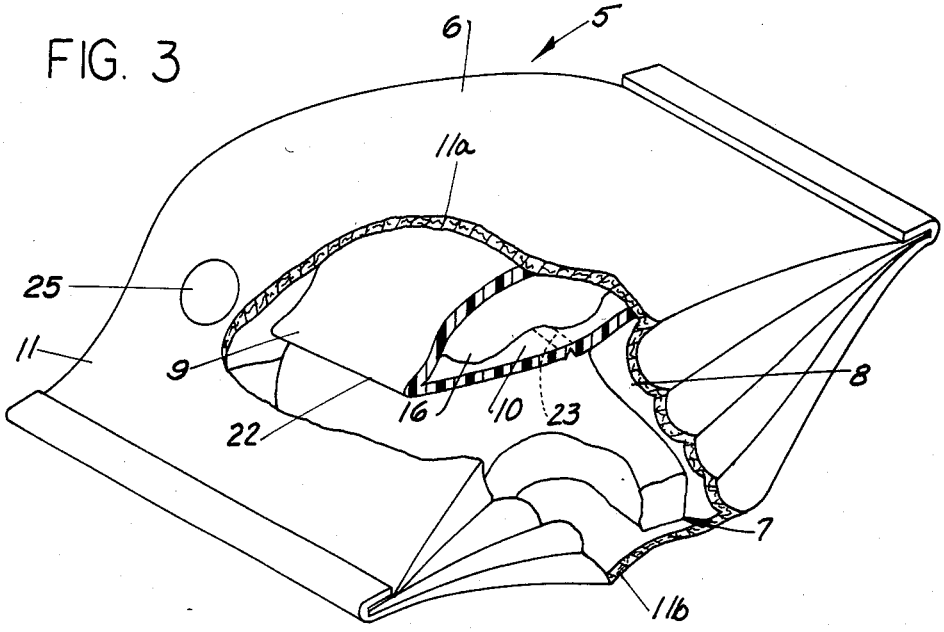
FIG. 3 is a front prospective view of a second embodiment of the package of the present invention.

It will be understood that practically any type of food may be used within the package such as various types of meats as illustrated in FIG. 3, as well as vegetables, fruit, snack foods and the like. Furthermore, various types of seasonings can be utilized in connection with packet 9. In any event, the temperature and heating time required by microwave oven 15 will vary depending upon the type of food utilized in connection with the package of the present invention.

For purposes of a typical but non-limiting example, the principles of the present invention were used to construct a microwave package containing a charge of popcorn kernals and an additive comprising coconut oil.

Package 6 was fabricated from a paper/film laminate available from Chase Bag Co. and comprising a 35-pound bag weight kraft paper outer layer having less than 5% pigment laminated to a 45-gauge polyester inner layer to produce a package approximately 12 inches long by 5½ inches wide having 4 inch gussets tapering toward sealed seams. This construction resulted in an interior cavity of about 260 cubic inches when the package was expanded. Package 6 was provided with 6–12 vent holes of approximately ⅛-inch diameter spaced ½-inch apart and closed with a 45 gauge polypropylene film having a softening temperature of about 160° C.–180° C.

Packet 9 was constructed of 45-gauge polypropylene film having a softening temperature of about 160° C.–180° C. and fabricated in a continuous film arrangement of the type illustrated in FIG. 4 and described hereinabove. The packet was attached to the inner surface of package 6 by means of a surlyn adhesive applied at the rate of about 7–10 pounds per ream.

The food charge comprised about 70–80 grams of popcorn kernals sized at about 65–75 kernals per 10 grams with a moisture content of about 14.5%–16% and a waste level of about 3.5%–6%. Such popping corn generally has a popping temperature of about 165° C.

The Packet 9 was filled at least 75% full with 76° coconut oil.

After the package was placed in a microwave oven operating at about 650 watts, it was observed that packet 9 softened and tore to disperse its contents approximately 1½–4 minutes after heating began. Furthermore, it was observed that the entire contents of the packet was substantially evenly dispersed over the popped popcorn kernals.

After the package was opened, it was also observed that the edges of the torn packet film appeared to be shriveled and were pressed flat against the inner surface of the package wall. None of the thermoplastic film had shredding or otherwise became detached from the package wall. Furthermore, upon inspection it appeared that the pressure within the package cavity during cooking forced the melted coconut oil to flow along the interior side walls of the package cavity to thoroughly coat the popped popcorn kernals.

It will be understood from the foregoing that various changes may be made in the invention within the scope and principle of the invention as expressed in the appended claims.

The embodiments of the invention in which an exclusive property or privilege is claimed are as follows:

1. A package for heating a food product within a conventional microwave oven comprising a flexible bag-like container having an interior cavity, a food product disposed within said cavity, and a flexible pouch-like packet disposed and secured within said cavity overlying said food product, a food additive sealed within said packet, at least a portion of said container being transmissive to microwave radiation of the type produced by the microwave oven so as to heat the food product without substantial heating of the package, said packet including means for automatically rupturing said packet and dispersing the additive over the food product without external manipulation of the packet when the package with the packet therein is exposed to microwave radiation within the microwave oven while the food product is being heated.

2. The package according to claim 1 wherein said packet includes first and second wall portions, said portions being joined together along a seam by means of a heat releasable adhesive, said seam opening when the package is exposed to said microwave radiation to release said additive.

3. The package according to claim 1 wherein said packet comprises at least one wall of sheet-like material attached to the interior surface of said container by means of heat releasable adhesive, said wall becoming detached from said interior surface when the package is exposed to said microwave radiation to release said additive.

4. The package according to claim 1 wherein said packet is attached to an interior surface of said container.

5. The package according to claim 4 wherein said surface comprises a container wall overlying the food product whereby the dispensed additive falls downwardly onto the food product.

6. The package according to claim 1 wherein said means comprises a thermoplastic film forming a portion at least of said packet, said film softening and then tearing to release the additive when the package is expposed to said microwave radiation.

7. The package according to claim 6 wherein said packet is completely formed from said film and is attached to an interior surface of said container.

8. The package according to claim 6 wherein said packet comprises a sheet of said film attached to said container surface so as to form a closed cavity therebetween, said additive being contained within said packet cavity.

9. The package according to claim 6 wherein said packet comprises a first wall of sheet-like material, a second wall of said film, and means joining said walls to form a pocket-like cavity therebetween for holding said additive, said first wall being attached to an interior surface of said container.

10. The package according to claim 6 wherein said container includes an opening therein, said packet comprising a first wall of sheet-like material, a second wall of said film, and means joining said walls to form a pocket-like cavity therebetween for holding said additive, said packet being positioned such that said first wall is attached to said container so as to cover said opening and said second wall is disposed within said container.

11. The package according to claim 6 wherein said film comprises polypropylene.

12. The package according to claim 6 wherein said packet is attached to an interior surface of said container overlying said food product such that when said film tears the additive is dispersed over the food product.

13. The package according to claim 6 wherein said film has a softening temperature of greater than about 160° C.

14. The package according to claim 6 where said thermoplastic film comprises a polyolefine.

15. The package according to claim 6 wherein said additive fills approximately 75%–100% of the interior cavity of the packet.

16. The package according to claim 1 including a plurality of openings in said container and means covering said openings for releasing pressure within said container cavity when the package is heated by exposing it to said microwave radition in the microwave oven.

17. The package according to claim 16 wherein said covering means comprises a thermoplastic film which softens and then tears to release pressure within said container.

18. A self-contained package for popping corn in a microwave oven comprising:

an expandable bag-like container fabricated from a flexible material generally transmissive to microwave radiation of the type produced in a microwave oven and having upper and lower spaced wall sections forming an interior cavity therebetween;

a plurality of popcorn kernels disposed within said container;

a flexible pouch-like packet having an interior cavity attached to the interior surface of said upper wall section within said container cavity such that the packet overlies the kernels when the package is disposed within a microwave oven with said upper wall section uppermost; and a food additive sealed within said packet cavity, said packet having at least a portion thereof formed from a thermoplastic film which softens and then tears without external manipulation of the packet when the package is exposed to said microwave radiation to cause said additive to fall downwardly onto the poped corn kernels.

19. The package according to claim 18 wherein said additive comprises coconut oil.

20. The package according to claim 18 wherein said film comprises a polyolefin.

21. The package according to claim 18 wherein said thermoplastic film comprises polypropylene having a softening temperature of about 160° C.–180° C.

22. The package according to claim 18 wherein said packet comprises a sheet of said film attached to said container surface, said closed cavity being formed between said film and said surface.

23. The package according to claim 18 wherein said packet comprises a first wall of sheet-like material, a second wall of said film, and means joining said walls to form said packet cavity therebetween, said first wall being attached to said interior surface of said container.

24. The package according to claim 18 wherein said container includes an opening therein, said packet comprising a first wall of sheet-like material, a second wall of said film, and means joining said walls to form said packet cavity therebetween, said packet being positioned such that said first wall is attached to the container so as to cover said opening and said second wall is disposed within said container.

25. The package according to claim 18 including a plurality of openings in said container and means associated with said openings for releasing pressure within said container when the package is exposed to microwave radiation in the microwave oven.

26. The package according to claim 25 wherein said covering means comprises a thermoplastic film having a softening temperature of about 160° C.–180° C.

27. A self-contained package for popping corn in a microwave oven comprising:

an exandable bag-like container fabricated from a flexible paper material generally transmissive to microwave radiation of the type produced in a microwave oven, said container having upper and lower spaced wall sections joined by gussetted side panels to form an interior cavity therebetween, said container being provided with a plurality of openings for releasing pressure within said cavity when the package is exposed to microwave radiation in the microwave oven;

a plurality of popcorn kernels disposed within said container on the interior surface of said lower wall section when the package is disposed within the microwave oven with said upper spaced wall section uppermost, said popcorn kernels havng a popping temperature of about 160° C. and a moisture content of about 14.5%–16%;

a flexible pouch-like packet having an interior cavity attached to the interior surface of said upper wall section within said container cavity such that the packet overlies the kernels when the package is disposed within a microwave oven with said upper wall section uppermost, at least a portion of said packet being formed from a thermoplastic film having a softening temperature of about 160° C.–180° C.; and a quantity of 76° coconut oil sealed within said filling at least 75% of said packet cavity, whereby said popcorn kernels are popped and said thermoplastic film softens and then tears without external manipulation of the packet when the package is exposed to said microwave radiation to cause the coconut oil in a melted state to fall downwardly onto the popped kernels.

28. The package according to claim 27 wherein said packet film softens and tears to disperse its contents within the range of about 1½–4 minutes after the package is first exposed to microwave radiation within the microwave oven.

* * * * *